US006370346B1

(12) United States Patent
Nishikawa

(10) Patent No.: US 6,370,346 B1
(45) Date of Patent: Apr. 9, 2002

(54) PRINTER DEVELOPING APPARATUS HAVING A LIQUID COMPONENT REMOVING UNIT

(75) Inventor: Hiroshi Nishikawa, Niigata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/607,552

(22) Filed: Jun. 29, 2000

(30) Foreign Application Priority Data

Jun. 30, 1999 (JP) ..... 11-185125

(51) Int. Cl.[7] ..... G03G 15/10
(52) U.S. Cl. ..... 399/249
(58) Field of Search ..... 399/237, 239, 399/249

(56) References Cited

U.S. PATENT DOCUMENTS 6,049,684 A * 4/2000 Nishikawa et al. ..... 399/249
6,085,054 A * 7/2000 Kusayanagi ..... 399/249
6,128,457 A * 10/2000 No et al. ..... 399/249
6,163,673 A * 12/2000 Shindo ..... 399/237

FOREIGN PATENT DOCUMENTS

JP 9171321 6/1997

* cited by examiner

*Primary Examiner*—Fred L Braun
(74) *Attorney, Agent, or Firm*—Ostrolenk, Faber, Gerb & Soffen, LLP

(57) ABSTRACT

A developing apparatus having a liquid developer supply unit for supplying a liquid developer to an electrostatic latent image on a belt type photosensitive body and a liquid component removing unit arranged at the downstream of the liquid developer supply unit so as to remove a liquid component from the liquid developer attached to the belt type photosensitive body. The liquid component removing unit includes a squeeze roller for removing a liquid component from the liquid developer attached to the belt type photosensitive body; and a second backup roller (liquid component removing auxiliary roller) which is in abutment with the squeeze roller via the belt type photosensitive body. The second backup roller has a diameter greater than that of the squeeze roller and a length almost identical to that of the squeeze roller.

15 Claims, 3 Drawing Sheets

PRINTER DEVELOPING APPARATUS HAVING A LIQUID COMPONENT REMOVING UNIT

BACKGROUND OF THE INVENTION

1. Field of the Invention

The present invention relates to a developing apparatus for a printer to be built in a printing apparatus, facsimile, a copying machine, or the like and in particular, to a developing apparatus using a liquid developer.

2. Description of the Related Art

FIG. 3 shows a conventional example. In FIG. 3, the reference numeral 101 denotes an endless belt type photosensitive body. Outside of this belt type photosensitive body 101, i.e., below the belt type photosensitive body 101 in FIG. 3(*a*), there are provided a development roller 102 and a squeeze roller 103.

The development roller 102 makes visible, i.e., develops an electrostatic latent image on the belt type photosensitive body 101 and is arranged with its rotary surface at a predetermined distance from the surface of the belt type photosensitive body 101 having the electrostatic latent image. The squeeze roller 103 serves to remove a portion of liquid developer remaining on the belt type photosensitive body 101. For this, the squeeze roller 103 is located at the downstream of the development roller 102 along the travelling surface of the belt type photosensitive body 101.

The reference numeral 121 denotes a first backup roller arranged against the development roller 102 via the belt type photosensitive body 101. The reference numeral 122 denotes a second backup roller arranged against the squeeze roller 103 via the belt type photosensitive body 101.

Beside the development roller 102, there is provided with a developer supply 105 for supplying a liquid developer to the development roller 102. Beside the squeeze roller 103, there is provided a cleaning blade 106 for removing a liquid developer from the squeeze roller 103.

The development roller 102, the developer supply 105, the squeeze roller 103, and the cleaning blade 106 are all contained in a developing apparatus casing 130. In a developing mode, these components are set as a unitary block at an advanced position toward the belt type photosensitive body 101, and in a development stop mode these components are set as a unitary block at a recessed position The squeeze roller 103 removes liquid developer remaining on the belt type photosensitive body 101 and makes the developed visible image into a film state. For this, the squeeze roller 103 rotates against the second backup roller 122 while sandwiching the belt type photosensitive body 101. Actually, the squeeze roller 103 is in a pressed state against the second backup roller 122 with a predetermined pressure.

In the aforementioned conventional example, the squeeze roller 103 should be pressed against the second backup roller 122, so as to evenly press the entire width of the belt type photosensitive body 101. In case when the diameter of the squeeze roller 103 is smaller than the diameter of the backup roller 122, there is a problem that the squeeze roller 103 is easily deflected. In order to prevent this, in the aforementioned conventional example, the diameter of the squeeze roller 103 is made greater.

However, in this case, if the diameter of the squeeze roller is made greater while using the same material and the same pressure, the nip width d (in FIG. 3(*b*)) formed on the abutment surface between the second backup roller 122 and the squeeze roller 103 becomes greater and the abutment pressure per a unit area becomes smaller. This causes a problem not only in making a visible image into a film state but also in removing remaining liquid developer because the portion from where the remaining liquid developer is to be removed has a concave form.

On the other hand, in order to eliminate the problem of FIG. 3, Japanese Patent Publication 9-171321 discloses an arrangement in which an auxiliary roller having a small width is provided at a central portion of the squeeze roller 103 for correcting the deflection.

However, after a long period of use, the central portion of the squeeze roller 103 is physically deformed and it becomes difficult for a visible image to be made into a uniform film state. Furthermore, there arises a problem that the squeeze roller 103 cannot have a long service life.

SUMMARY OF THE INVENTION

It is therefore an object of the present invention to provide a developing apparatus capable of smoothly making into a visible image an electrostatic latent image on the belt type photosensitive body, making the visible image into a uniform film state, effectively removing remaining liquid developer, and having a long service life.

In order to achieve the aforementioned object, the present invention provides a developing apparatus for a printer, the apparatus comprising a liquid developer supply unit for supplying a liquid developer to a predetermined electrostatic latent image on a belt type photosensitive body and a liquid component removing unit arranged at the downstream of the liquid developer supply unit so as to remove a liquid component from the liquid developer attached to the belt type photosensitive body by the liquid developer supply unit, wherein the liquid component removing unit includes a squeeze roller arranged at the liquid developer side of the belt type photosensitive body so as to remove a liquid component from the liquid developer attached to the belt type photosensitive body and a liquid component removing auxiliary roller which is in abutment with the squeeze roller via the belt type photosensitive body. And the liquid component removing auxiliary roller has a diameter greater than a diameter of the squeeze roller and a length almost identical to a length of the squeeze roller.

Accordingly, it is possible to smoothly develop the electrostatic latent image on the belt type photosensitive body. Furthermore, the liquid component removing unit can effectively remove a remaining liquid developer and an unnecessary liquid component from the belt type photosensitive body. Simultaneously with this, the visible image developed by the liquid developer supply unit is smoothly made into a film state by cooperation of the liquid component removing auxiliary roller and the squeeze roller.

Since the liquid component removing auxiliary roller has a diameter greater than that of the squeeze roller and a length almost identical to that of the squeeze roller, it is possible to almost completely eliminate the problem of curving (bending) of the squeeze roller in the conventional example, disturbing the process of making the visible image into a film state. Thus, it is possible to continue the development process in a stable state for a long period of time.

The liquid component removing unit may further include an SQ support roller which is in abutment with the squeeze roller with a predetermined pressure and removes a liquid developer from the squeeze roller.

Since the rotation of the squeeze roller is entirely supported by the SQ support roller, the rotation of the squeeze roller is made more stable. Moreover, the entire surface of the squeeze roller is evenly supported and accordingly, it is possible to completely eliminate the problem of abrasion or deformation of the center portion. This brings out operation stability and durability.

Here, the SQ support roller may have a diameter greater than that of the squeeze roller. This further increases the operation stability of the squeeze roller and durability against vibration or the like.

The liquid component removing auxiliary roller, the squeeze roller, and the SQ support roller may have rotation centers set on a single line.

Accordingly, when the squeeze roller is pressed against the liquid component removing auxiliary roller, the pressure can be effectively transmitted.

Here, the squeeze roller and the SQ support roller may be constituted so as to be movable as a unitary block apart from the belt type photosensitive body. With this configuration, it is possible to smoothly switch the developing apparatus between a development mode and a non-development mode.

Moreover, the squeeze roller may be constituted so as to be rotated in a reverse direction at a predetermined timing. This enables to rapidly and completely remove the remaining liquid developer and unnecessary liquid component from the belt type photosensitive body, which in turn enables to obtain a high quality development including the film state of the visible image.

BRIEF DESCRIPTION OF THE DRAWINGS

FIG. 2(*a*) shows a first stage when the developing unit casing retreats and FIG. 2(*b*) shows a second stage when the developing unit casing retreats FIG. 3(*a*) shows the conventional example in operation and FIG. 3(*b*) shows a nip width generated on the squeeze roller during operation.

DESCRIPTION OF THE PREFERRED EMBODIMENTS

Hereinafter, explanation will be given on an embodiment of the present invention with reference to FIG. 1 to FIG. 3.

Figure 1:
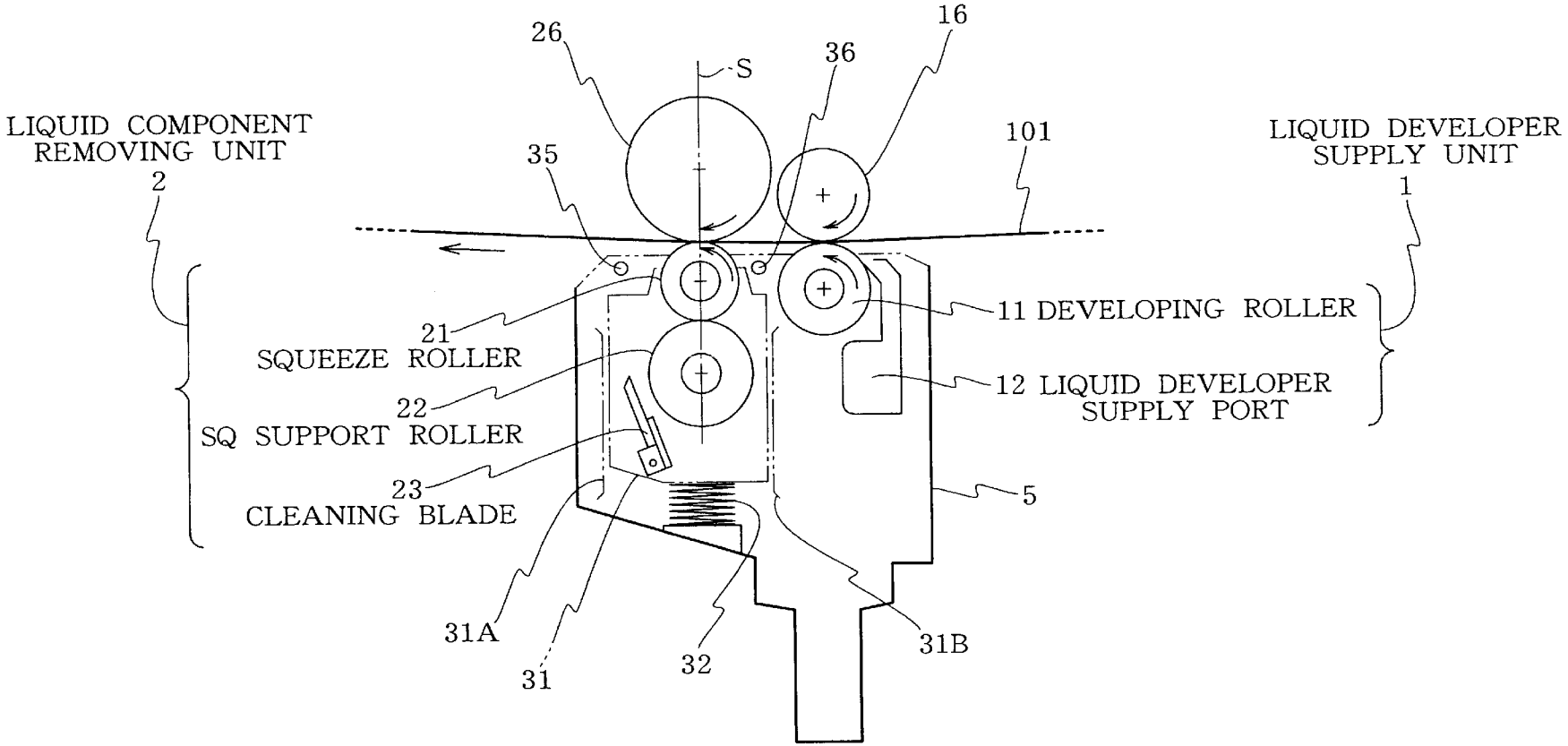
FIG. 1 schematically shows a developing apparatus according to an embodiment of the present invention.

In FIG. 1, the reference symbol 101 denotes an endless belt type photosensitive body. Outside of this endless belt type photosensitive body 101, there are arranged a liquid developer supply unit 1 for supplying a liquid developer to a predetermined electrostatic latent image on the belt type photosensitive body and a liquid component removing unit 2 which is arranged at the downstream of the liquid developer supply unit 1 for removing a liquid component of the liquid developer supplied to the belt type photosensitive body 101 by the liquid developer supply unit 1.

The belt type photosensitive body 101 includes a resin film having a conductive surface, which is covered with a photosensitive layer, which is covered with a barrier layer for protecting the photosensitive layer, which barrier layer is covered with a release layer for readily releasing the liquid developer.

The liquid developer supply unit 1 includes a developing roller 11 and a liquid developer supply port 12. The developing roller 11 is a metal roller for developing an electrostatic latent image on the belt type photosensitive body 101 into a visible image. The developing roller 11 is arranged so that, during operation, its rotation surface is at a predetermined distance (0.15 mm for example) from the surface of the belt type photosensitive body 101 having an electrostatic latent image. Moreover, the liquid developer supply port 12 supplies a liquid developer to the developing roller 11 and is always at an identical positional relationship with the developing roller 11.

The reference symbol 16 denotes a first backup roller as an auxiliary roller for development arranged so as to be opposed to the developing roller 11 via the belt type photosensitive body 101. This first backup roller 16 functions as an opposing roller for maintaining a predetermined development gap between the belt type photosensitive body 101 and the developing roller 11, and has a diameter and a length almost identical to those of the developing roller 11.

On the other hand, the liquid component removing unit 2 includes a squeeze roller 21, an SQ support roller 22, and a cleaning blade 23. The squeeze roller 21 is arranged in a pressure contact with the SQ support roller 22 which is positioned below the squeeze roller 21 in FIG. 1. The squeeze roller 21 and the SQ support roller 22 maintain a predetermined positional relationship. The liquid developer collected by the SQ support roller 22 is removed at a predetermined timing by the cleaning blade 23.

The reference symbol 26 denotes a second backup roller arranged to oppose the squeeze roller 21 via the belt type photosensitive body 101 and serving as an auxiliary roller for removing a liquid component. The second backup roller 26 has a diameter greater than that of the squeeze roller 21 and a length almost identical to that of the squeeze roller 21. The second backup roller 26 is required so that the squeeze roller 21 is in a pressure contact with the belt type photosensitive body 101.

Here, the squeeze roller 21 is formed from an elastic material such as rubber and, as in the aforementioned conventional example, removes a liquid development remaining on the belt type photosensitive body 101 cooperating with the second backup roller 26. At the same time, the squeeze roller 21 has a function to make a developed image into a film state.

As has been described above, the second backup roller 26 (auxiliary roller for removing a liquid component) has a diameter greater than that of the squeeze roller 21 and it is possible to reduce a nip width (concave width) of the squeeze roller 21 on the contact surface with the second backup roller 26. Accordingly, the abutment pressure per unit area can be increased and a developed image on the belt type photosensitive body can be made into a film state with a high efficiency.

Furthermore, the SQ support roller 22 is also made from an elastic material such as rubber and arranged in a pressure contact with the squeeze roller 21. During a printing operation, the remaining liquid developer transferred from the belt type photosensitive body 101 onto the squeeze roller 21 is further transferred to the SQ support roller 22 and finally removed by the cleaning blade 23.

Moreover, the SQ support roller 22 is arranged so as to bring the squeeze roller 21 into a pressure abutment with the backup roller 26 during an operation. Thus, the SQ support roller 22 functions to correct deflection generated in the squeeze roller 21.

In order to effectively realize the aforementioned function, the SQ support roller 22 has a diameter greater than that of the squeeze roller 21.

Here, the two rollers (the SQ support roller 22 and the squeeze roller 21) constituting the liquid component removing unit 2 and the second backup roller 26 have rotation centers on the line S almost vertical to the travelling surface of the belt type photosensitive body 101. Thus, the pressurizing direction passes through the rotation centers of the respective rollers along one and the same line. Accordingly, it is possible to maintain a stable operation of the liquid component removing unit 2 for a long period of time, i.e., to obtain a long service life.

The liquid component removing unit 2 having the aforementioned configuration is entirely supported by a movable plate 31 and pressed against the belt type photosensitive body 101 with an initial pressure of a predetermined level by a spring 32 for example. The reference symbols 31A and 31B denote guide members for the movable plate 31.

In the state of FIG. 1 where the developing unit casing 5 has advanced toward the belt type photosensitive body 101, the squeeze roller 21 of the liquid component removing unit 2 is brought into abutment with the second backup roller 26 with a predetermined pressure (via the belt type photosensitive body 101) for performing the aforementioned operation.

The liquid developer supply unit 1 and the liquid component removing unit 2 are entirely contained in and held by the developing unit casing 5. As shown in FIG. 1, the developing unit 5 has an open top and the developing roller 11 of the liquid developer supply unit 1 and the squeeze roller 21 of the liquid component removing unit 2 partially protrude from the casing 5 toward the belt type photosensitive body 101. Here, the reference symbols 35 and 36 respectively denote stoppers for the movable plate 31. The stoppers are provided on the developing unit casing 5.

For a development mode, these components are urged as a unitary block by drive means (not depicted) to advance toward the belt type photosensitive body 101 and for a halt mode, these components retreat from the belt type photosensitive body 101.

Figure 2B:
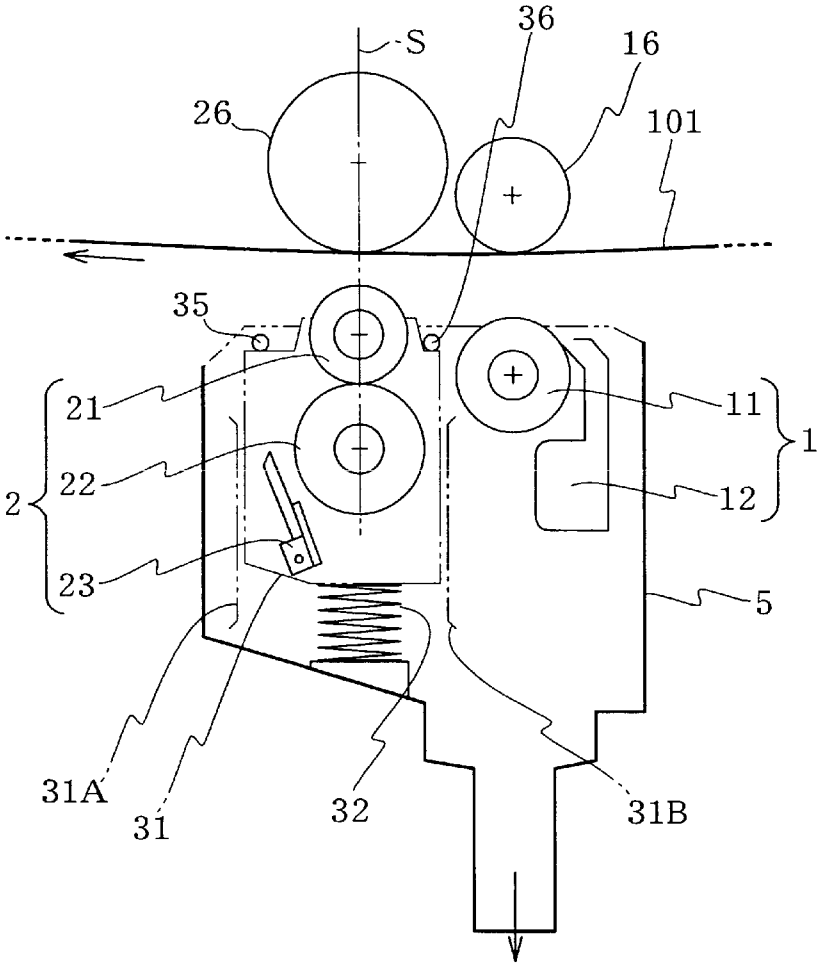
FIG. 2 shows an operation of the embodiment of FIG. 1.
Figure 2A:
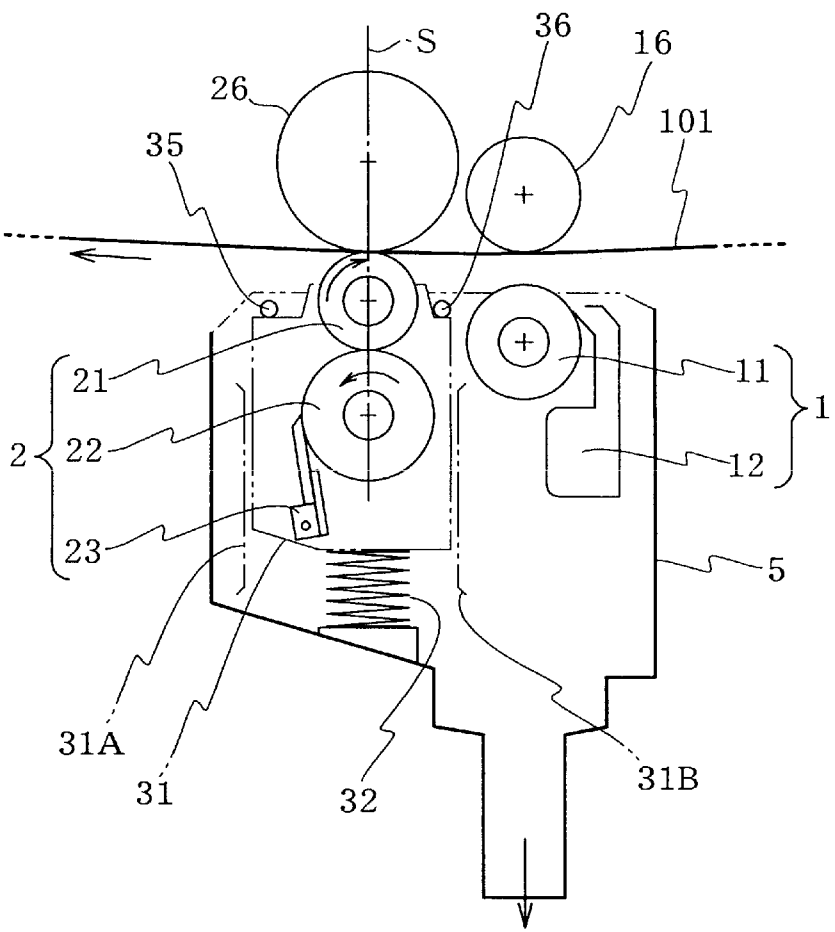
Figure 3B:
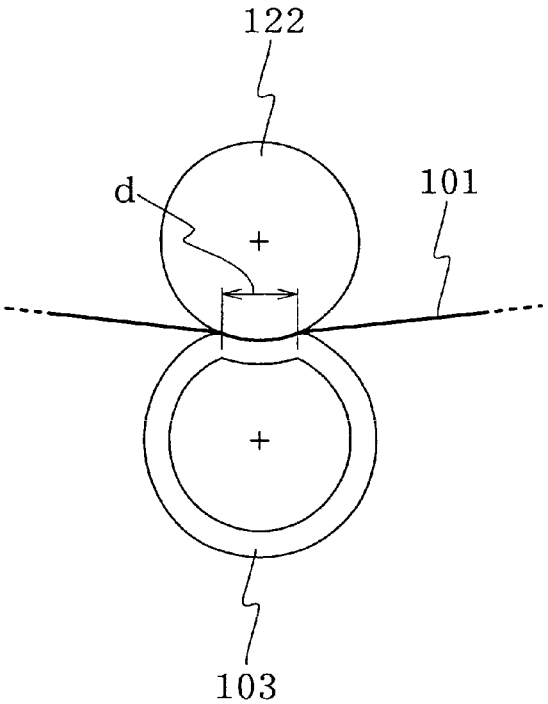
FIG. 3 shows a conventional example of developing apparatus.
Figure 3A:
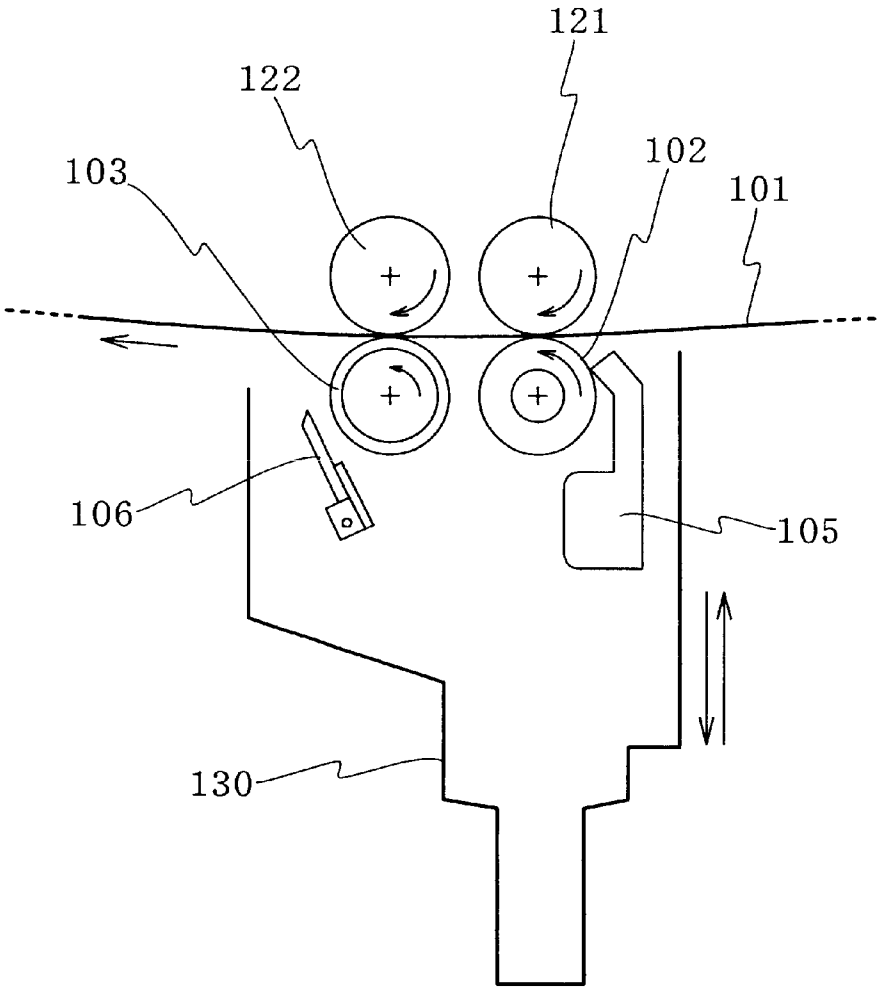

Here, for the halt mode, the developing unit casing retreats through two stages as shown in FIG. 2(*a*) and FIG. 2(*b*). At the first stage (FIG. 2(*a*)), the developing unit casing 5 and the liquid developer supply unit 1 retreat; and at the second stage (FIG. 2(*b*)), the developing unit casing 5, the liquid developer supply unit 1, and the liquid component removing unit 2 retreat completely.

At the first stage of retreat, the squeeze roller 21 of the liquid component removing unit 2 maintains abutment with the belt type photosensitive body 101 with a reduced abutment pressure against the second backup roller 26. In this state, the squeeze roller 21 is rotated in the reverse direction by drive means (not depicted). The liquid developer attached to the belt type photosensitive body 101 is effectively adsorbed by the squeeze roller 21 with a reduced abutment pressure.

Next, explanation will be given on the operation of the aforementioned embodiment.

Firstly, the development operation will be explained with reference to FIG. 1.

The belt type photosensitive body 101 is exposed by a laser unit (not depicted) and a predetermined image is formed as an electrostatic latent image on the belt type photosensitive body 101. The electrostatic latent image is fed by rotary travel of the belt type photosensitive body 101 to a development region (the area in the proximity of the developing roller 11) and developed into a visible image by the developing roller 11.

Here, beside the developing roller 11, there is provided a liquid developer supply port 12, which supplies a predetermined amount of liquid developer. When a liquid developer is supplied to the belt type photosensitive body 101 by the developing roller 11, a toner component adheres to an electrostatic latent image, thus performing development.

On the other hand, immediately after the development, an image (visible image) and a liquid developer remain on the belt type photosensitive body 101 and the image is in a wet state. Subsequently, the belt type photosensitive body 101 is pressed against the second backup roller 26 by the squeeze roller 21 of the liquid component removing unit 2. Here, the remaining liquid developer is sucked by the squeeze roller 21 and a liquid component from the image portion is also sucked by the squeeze roller 21. Thus, only a toner component remains on the image and the image is pressed into a film state.

In this case, the SQ support roller 22 is in a pressed state against the squeeze roller 21. Even during operation of the squeeze roller 21 immediately after the development, the SQ support roller 22 is in a pressed state as a driven wheel. Accordingly, a deflection (curve) generated in the squeeze roller 21 by the pressure abutment with the second backup roller 26 is corrected by the SQ support roller 22.

Next, explanation will be given on a halt mode after completion of the aforementioned development with reference to FIG. 2(*a*) and FIG. 2(*b*).

When the development mode is switched to the halt mode, the developing unit casing 5 retreats in two stages as has been described above. In the first stage, as shown in FIG. 2(*a*), the developing unit casing 5 and the liquid developer supply unit 1 retreat, and in the second stage, as shown in FIG. 2(*b*), the developing unit casing 5, the liquid developer supply unit 1, and the liquid component removing unit 2 retreat completely.

In the first stage, the squeeze roller 21 of the liquid component removing unit 2 is still in contact with the belt type photosensitive body 101 with a reduced abutment pressure against the second backup roller 26. In this case, the abutment state is pushed by a spring 32 upward in the figure and the stoppers 35 and 36 suppresses protrusion upward. Thus, the abutment with the belt type photosensitive body 101 is maintained with a reduced abutment pressure.

When the first stage is set in, the squeeze roller 21 is rotated in the reverse direction by a drive unit (not depicted). Thus, the liquid developer remaining on the belt type photosensitive body 101 is successively adsorbed by the squeeze roller 21 while the belt type photosensitive body 101 is travelling.

This operation is performed in the aforementioned first stage when the belt type photosensitive body 101 travels, for example, from the region of the liquid developer supply unit 1 to the region of the liquid component removing unit 2. In this process, the cleaning blade 23 is actuated. In this case, the remaining liquid developer removed from the belt type photosensitive body 101 by the squeeze roller 21 is further removed via the SQ support roller 22 by the cleaning blade 23. Thus, the development of the belt type photosensitive body 101 is complete.

When this first stage is complete, the developing unit casing 5 further retreats to be switched to a second stage as shown in FIG. 2(*b*). In the second stage, the liquid developer supply unit 1 and the liquid component removing unit 2 completely retreat from the belt type photosensitive body 101 as shown in FIG. 2(*b*), completing the developing process.

The present invention having the aforementioned configuration has various merits as follows. The electrostatic latent image on the belt type photosensitive body can be developed smoothly. The remaining liquid developer and the unnecessary liquid component can be smoothly removed by the liquid component removing unit. Simultaneously with this, by the cooperation of the liquid component removing auxiliary roller and the squeeze roller, the visible image which has been developed by the liquid developer supply unit can be smoothly made into a film state. Furthermore, since the liquid component removing auxiliary roller has a diameter greater than that of the squeeze roller, it is possible to reduce the nip width (concave width) of the squeeze roller at the abutment surface with the liquid component removing auxiliary roller. This increases an abutment pressure per unit area, which enables to make the visible image on the belt type photosensitive body into a film state with a high efficiency. Moreover, the squeeze roller has a length almost identical to that of the liquid component removing auxiliary roller. This enables to eliminate the conventional problem that the center portion of the squeeze roller is curved, disturbing the visible image to be made into a film state. Thus, it is possible to continue the development operation in a stable state for a long period of time.

Moreover, an SQ support roller may be provided so as to support the rotation of the squeeze roller. The liquid developer on the squeeze roller is effectively adsorbed by abutment rotation of the SQ support roller. Furthermore, the SQ support roller eliminates curving (bending) of the center portion of the squeeze roller, stabilizing the rotation of the squeeze roller. Since the entire length of the squeeze roller is evenly supported by the SQ support roller, it is possible to completely eliminate abrasion or deformation of the center portion for example. This enables to obtain a stable operation and durability of the entire apparatus.

Furthermore, the SQ support roller has a diameter greater than that of the squeeze roller. This further increases the operation stability of the squeeze roller and durability against vibration or the like.

Moreover, the liquid component removing auxiliary roller, the squeeze roller, and the SQ support roller have rotation centers aligned along a single line. Accordingly, when the squeeze roller is pressed against the liquid component removing auxiliary roller, the pressure can be effectively transmitted. The visible image which has been developed can be effectively made into a film state.

Furthermore, the squeeze roller and the SQ support roller are constituted so as to be movable as a unitary block with respect to the belt type photosensitive body and accordingly, it is possible to smoothly switch the developing unit between a development mode and a non-development mode. This secures a stable operation during development.

Moreover, the squeeze roller is constituted so as to be rotated in a reverse direction at a predetermined timing. This enables, after development, to rapidly and completely remove the remaining liquid developer and the unnecessary liquid component from the belt type photosensitive body, which in turn enables to obtain a high-quality development including the film state of a visible image.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 11-185125 (Filed on Jun. 30, 1999) including specification, claims, drawings and summary are incorporated herein by reference in its entirety.

What is claimed is:

1. A developing apparatus for a printer, the apparatus comprising:

a liquid developer supply unit for supplying a liquid developer to a predetermined electrostatic latent image on a belt type photosensitive body and a liquid component removing unit arranged downstream of the liquid developer supply unit so as to remove a liquid component from the liquid developer attached to the belt type photosensitive body by the liquid developer supply unit, wherein the liquid component removing unit includes a squeeze roller arranged at a liquid developer side of the belt type photosensitive body so as to remove a liquid component from the liquid developer attached to the belt type photosensitive body, a liquid component removing auxiliary roller which is in abutment with the squeeze roller via the belt type photosensitive body, and a support roller which is in abutment with the squeeze roller with a predetermined pressure and removes a liquid developer from the squeeze roller, the liquid component removing auxiliary roller having a diameter greater than a diameter of the squeeze roller and a length almost identical to a length of the squeeze roller, wherein the liquid component removing auxiliary roller, the squeeze roller, and the support roller have rotation centers arranged on a single line.

2. A developing apparatus for a printer as claimed in claim 1, wherein the squeeze roller and the support roller are movable as a unitary block apart from the belt type photosensitive body.

3. A developing apparatus for a printer as claimed in claim 2, wherein the squeeze roller is operable so as to be rotated in a reverse direction.

4. A developing apparatus for a printer, the apparatus comprising:

a liquid developer supply unit for supplying a liquid developer to a predetermined electrostatic latent image on a belt type photosensitive body and a liquid component removing unit arranged downstream of the liquid developer supply unit so as to remove a liquid component from the liquid developer attached to the belt type photosensitive body by the liquid developer supply unit, wherein the liquid component removing unit includes a squeeze roller arranged at a liquid developer side of the belt type photosensitive body so as to remove a liquid component from the liquid developer attached to the belt type photosensitive body, a liquid component removing auxiliary roller which is in abutment with the squeeze roller via the belt type photosensitive body, and a support roller which is in abutment with the squeeze roller with a predetermined pressure and removes a liquid developer from the squeeze roller, the liquid component removing auxiliary roller having a diameter greater than a diameter of the squeeze roller and a length almost identical to a length of the squeeze roller, the support roller having a diameter greater than the diameter of the squeeze roller, and the liquid component removing auxiliary roller, the squeeze roller, and the support roller have rotation centers arranged on a single line.

5. A developing apparatus for a printer as claimed in claim 4, wherein the squeeze roller and the support roller are movable as a unitary block apart from the belt type photosensitive body.

6. A developing apparatus for a printer as claimed in claim 5, wherein the squeeze roller is operable so as to be rotated in a reverse direction.

7. A developing apparatus for a printer, the apparatus comprising:

a liquid developer supply unit for supplying a liquid developer to a predetermined electrostatic latent image on a belt type photosensitive body and a liquid component removing unit arranged downstream of the liquid developer supply unit so as to remove a liquid component from the liquid developer attached to the belt type photosensitive body by the liquid developer supply unit, wherein the liquid component removing unit includes a squeeze roller arranged at a liquid developer side of the belt type photosensitive body so as to remove a liquid component from the liquid developer attached to the belt type photosensitive body, a liquid component removing auxiliary roller which is in abutment with the squeeze roller via the belt type photosensitive body and a support roller which is in abutment with the squeeze roller with a predetermined pressure and removes a liquid developer from the squeeze roller, the liquid component removing auxiliary roller having a diameter greater than a diameter of the squeeze roller and a length almost identical to a length of the squeeze roller, wherein the squeeze roller and the support roller are movable as a unitary block apart from the belt type photosensitive body.

8. A developing apparatus for a printer as claimed in claim 7, wherein the squeeze roller is operable so as to be rotated in a reverse direction.

9. A developing apparatus for a printer, the apparatus comprising:

a liquid developer supply unit for supplying a liquid developer to a predetermined electrostatic latent image on a belt type photosensitive body and a liquid component removing unit arranged downstream of the liquid developer supply unit so as to remove a liquid component from the liquid developer attached to the belt type photosensitive body by the liquid developer supply unit, wherein the liquid component removing unit includes a squeeze roller arranged at a liquid developer side of the belt type photosensitive body so as to remove a liquid component from the liquid developer attached to the belt type photosensitive body, a liquid component removing auxiliary roller which is in abutment with the squeeze roller via the belt type photosensitive body, and a support roller which is in abutment with the squeeze roller with a predetermined pressure and removes a liquid developer from the squeeze roller, the liquid component removing auxiliary roller having a diameter greater than a diameter of the squeeze roller and a length almost identical to a length of the squeeze roller, the support roller having a diameter greater than the diameter of the squeeze roller, and the squeeze roller and the support roller are movable as a unitary block apart from the belt type photosensitive body.

10. A developing apparatus for a printer as claimed in claim 9, wherein the squeeze roller is operable so as to be rotated in a reverse direction.

11. A developing apparatus comprising:

a belt;

a developer supply unit positioned to deposit liquid developer on the belt;

a liquid component removing unit operable to remove a liquid component from the liquid developer on the belt, the liquid component removing unit including:

a squeeze roller that removes the liquid component from the liquid developer on the belt;

an auxiliary roller in abutment with the belt so as to urge the belt against the squeeze roller, the auxiliary roller having a diameter greater than a diameter of the squeeze roller and a length substantially equal to a length of the squeeze roller; and a support roller in abutment with the squeeze roller, the support roller removing the liquid component from the squeeze roller, wherein the squeeze roller, the auxiliary roller and the support roller have axes of rotation arranged in common plane.

12. A developing apparatus as recited in claim 11, wherein the squeeze roller and the support roller are movable as a unitary block out of contact with the belt.

13. A developing apparatus as recited in claim 11, wherein the support roller has a diameter greater than the diameter of the squeeze roller.

14. A developing apparatus comprising:

a belt;

a developer supply unit positioned to deposit liquid developer on the belt;

a liquid component removing unit operable to remove a liquid component from the liquid developer on the belt, the liquid component removing unit including:

a squeeze roller that removes the liquid component from the liquid developer on the belt;

an auxiliary roller in abutment with the belt so as to urge the belt against the squeeze roller, the auxiliary roller having a diameter greater than a diameter of the squeeze roller and a length substantially equal to a length of the squeeze roller; and a support roller in abutment with the squeeze roller, the support roller removing the liquid component from the squeeze roller, wherein the squeeze roller and the support roller are movable as a unitary block out of contact with the belt.

15. A developing apparatus as recited in claim 14, wherein the support roller has a diameter greater than the diameter of the squeeze roller.

* * * * *

UNITED STATES PATENT AND TRADEMARK OFFICE

CERTIFICATE OF CORRECTION

PATENT NO. : 6,370,346 B1
APPLICATION NO. : 09/607552
DATED : April 9, 2002
INVENTOR(S) : Nagahisa Yuasa It is certified that error appears in the above-identified patent and that said Letters Patent is hereby corrected as shown below:

On the title page item [73] Please insert
(73) Assignee: Fuji Xerox Co., Ltd., Tokyo, (JP)

Signed and Sealed this

Nineteenth Day of December, 2006

JON W. DUDAS
*Director of the United States Patent and Trademark Office*